US008657065B1

(12) United States Patent
Hill

(10) Patent No.: US 8,657,065 B1
(45) Date of Patent: Feb. 25, 2014

(54) EXHAUST VALVE WITH RESILIENT SPRING PAD

(71) Applicant: Tenneco Automotive Operating Company Inc., Lake Forest, IL (US)

(72) Inventor: William E. Hill, Ann Arbor, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 0 days.

(21) Appl. No.: 13/715,172

(22) Filed: Dec. 14, 2012

(51) Int. Cl.
*F01N 1/00* (2006.01)

(52) U.S. Cl.
USPC ..... 181/254; 181/237

(58) Field of Classification Search
USPC ..... 181/254, 237; 137/855, 856, 857
See application file for complete search history.

(56) References Cited

U.S. PATENT DOCUMENTS

| | | | | |
|---|---|---|---|---|
| 1,613,332 | A | | 1/1927 | Goetz |
| 1,709,426 | A | | 4/1929 | Beery |
| 1,832,090 | A | | 11/1931 | Branche |
| 1,840,082 | A | | 1/1932 | Breer |
| 1,860,892 | A | | 5/1932 | Gray |
| 2,072,372 | A | | 3/1937 | Kingsley |
| 2,157,030 | A | | 5/1939 | Starkweather |
| 2,268,806 | A | | 1/1942 | Curtis |
| 2,380,374 | A | | 7/1945 | Anderson |
| 2,556,277 | A | | 6/1951 | Hill et al. |
| 2,855,283 | A | | 10/1958 | Schumacher |
| 2,986,373 | A | | 5/1961 | Masheder |
| 3,020,980 | A | | 2/1962 | Baker et al. |
| 3,406,783 | A | | 10/1968 | Haffer |
| 3,625,249 | A | | 12/1971 | Karr |
| 3,703,937 | A | * | 11/1972 | Tenney ..... 181/226 |
| 4,264,344 | A | | 4/1981 | Ludecke et al. |
| 4,356,801 | A | | 11/1982 | Graham |
| 4,378,003 | A | | 3/1983 | Imamura |
| 4,396,034 | A | | 8/1983 | Cherniak |
| 4,541,506 | A | | 9/1985 | Venning et al. |
| 4,563,605 | A | | 1/1986 | Gerber |
| 4,565,176 | A | | 1/1986 | Alf et al. |
| 4,707,987 | A | | 11/1987 | Atkin |
| 4,805,571 | A | | 2/1989 | Humphrey |
| 4,825,983 | A | | 5/1989 | Nakanishi |
| 4,903,486 | A | | 2/1990 | Finkle |
| 5,044,396 | A | | 9/1991 | Daudet et al. |
| 5,355,673 | A | | 10/1994 | Sterling et al. |
| 5,392,812 | A | | 2/1995 | Herron |

(Continued)

FOREIGN PATENT DOCUMENTS

| | | |
|---|---|---|
| EP | 1045180 | 10/2000 |
| JP | 1997-303143 | 11/1997 |

(Continued)

*Primary Examiner* — Forrest M Phillips
(74) *Attorney, Agent, or Firm* — Harness, Dickey & Pierce, P.L.C.

(57) ABSTRACT

An exhaust pressure actuated valve assembly for placement inside a tubular exhaust conduit includes a valve plate rotatable between open and closed positions. An axle is adapted to pivotally couple the valve plate to the exhaust conduit about a longitudinal axis of the axle. The axle axis is adapted to extend in a direction substantially perpendicular to a direction of exhaust flow through the conduit. A cantilevered spring pad has a first portion coupled to the valve plate and a second portion spaced apart from the valve plate. The second portion is oriented to contact an inner surface of the conduit as the valve plate moves toward the closed position to dampen vibration.

18 Claims, 5 Drawing Sheets

(56) References Cited

U.S. PATENT DOCUMENTS

| | | | | |
|---|---|---|---|---|
| 5,581,056 | A | 12/1996 | Bellgardt et al. | |
| 5,633,482 | A | 5/1997 | Erion et al. | |
| 5,692,374 | A | 12/1997 | Seki et al. | |
| 5,723,829 | A | 3/1998 | Inomata et al. | |
| 5,739,483 | A | 4/1998 | Yashiro et al. | |
| 5,744,762 | A | 4/1998 | Seki et al. | |
| 5,749,335 | A | 5/1998 | Flanery et al. | |
| 5,801,343 | A | 9/1998 | Suzuki et al. | |
| 5,813,380 | A | 9/1998 | Takahashi et al. | |
| 5,821,474 | A | 10/1998 | Olszok et al. | |
| 5,839,489 | A | 11/1998 | Ganachaud et al. | |
| 5,931,052 | A | 8/1999 | Zhao et al. | |
| 5,971,098 | A | 10/1999 | Suzuki et al. | |
| 5,971,859 | A | 10/1999 | Runge et al. | |
| 5,984,045 | A | 11/1999 | Maeda et al. | |
| 6,065,564 | A * | 5/2000 | Uegane | 181/237 |
| 6,189,650 | B1 | 2/2001 | Inuzuka et al. | |
| 6,193,214 | B1 | 2/2001 | Schatz | |
| 6,332,442 | B1 | 12/2001 | Komada et al. | |
| 6,499,562 | B1 | 12/2002 | Elfinger et al. | |
| 6,527,006 | B2 | 3/2003 | Jackson | |
| 6,536,567 | B2 | 3/2003 | Nakanishi | |
| 6,553,963 | B1 | 4/2003 | Noble | |
| 6,564,902 | B1 | 5/2003 | Saberi | |
| 6,581,721 | B2 | 6/2003 | Nagai et al. | |
| 6,598,390 | B2 | 7/2003 | Chang | |
| 6,604,516 | B1 | 8/2003 | Krimmer et al. | |
| 6,637,545 | B1 | 10/2003 | Jonsson et al. | |
| 6,640,927 | B1 | 11/2003 | Turner | |
| 6,732,511 | B2 * | 5/2004 | Zintel et al. | 60/324 |
| 7,066,296 | B2 * | 6/2006 | Uegane et al. | 181/254 |
| 7,182,171 | B2 | 2/2007 | Weinert et al. | |
| 7,201,142 | B2 | 4/2007 | Peffley et al. | |
| 7,310,942 | B2 | 12/2007 | Shiga et al. | |
| 7,434,570 | B2 | 10/2008 | Hill | |
| 8,056,673 | B2 * | 11/2011 | Zelinski | 181/235 |
| 2002/0033303 | A1 * | 3/2002 | Nagai et al. | 181/237 |
| 2003/0000582 | A1 | 1/2003 | Jackson | |
| 2003/0005970 | A1 * | 1/2003 | Rim | 137/856 |
| 2004/0065503 | A1 * | 4/2004 | Uegane et al. | 181/237 |
| 2004/0178015 | A1 | 9/2004 | Wiemeler et al. | |
| 2006/0272322 | A1 | 12/2006 | Abram et al. | |
| 2007/0080020 | A1 * | 4/2007 | Emmett | 181/237 |
| 2007/0107981 | A1 * | 5/2007 | Sicotte | 181/237 |
| 2008/0223025 | A1 | 9/2008 | Hill | |
| 2008/0224083 | A1 | 9/2008 | Hill | |
| 2008/0245063 | A1 | 10/2008 | Hill | |
| 2009/0127023 | A1 | 5/2009 | Abram et al. | |
| 2011/0210231 | A1 * | 9/2011 | D'Aluisio | 248/629 |

FOREIGN PATENT DOCUMENTS

| | | |
|---|---|---|
| JP | 1998-141041 | 5/1998 |
| JP | 2000-002112 | 1/2000 |
| JP | 2002-235536 | 8/2002 |
| JP | 2002-303120 | 10/2002 |
| JP | 2006-322411 | 11/2006 |
| KR | 10-1998-0002656 | 3/1998 |
| KR | 10-1998-0009780 | 4/1998 |
| KR | 10-2001-0038902 | 5/2001 |
| KR | 10-0916809 | 9/2009 |
| WO | WO2008-115212 | 9/2008 |

* cited by examiner

EXHAUST VALVE WITH RESILIENT SPRING PAD

FIELD

The present disclosure relates to a valve for an exhaust system. The valve includes a rotatable valve plate equipped with a vibration damping spring pad.

BACKGROUND

This section provides background information related to the present disclosure which is not necessarily prior art.

Many exhaust systems in the automotive field have attempted to use both active and passive valve assemblies to alter the characteristics of exhaust flow through a conduit as the exhaust pressure increases due to increasing engine speed. Active valves carry the increased expense of requiring a specific actuating element, such as an electric motor or a solenoid. Passive valves utilize the pressure of the exhaust stream in the conduit with which the valve is associated.

Either type of valve may be susceptible to problems of accelerated wear, vibratory noise, or chatter when a closing element such as a valve plate of the valve switches from an open position to a fully closed position and a portion of the valve plate contacts an inner surface of the conduit. Electric motors may be controlled to reduce the rate of valve plate movement as the plate approaches the conduit. This level of control is typically unavailable for passive valves that are loaded toward the closed position by a spring.

SUMMARY

This section provides a general summary of the disclosure, and is not a comprehensive disclosure of its full scope or all of its features.

An exhaust pressure actuated valve assembly for placement inside a tubular exhaust conduit includes a valve plate rotatable between open and closed positions. An axle is adapted to pivotally couple the valve plate to the exhaust conduit about a longitudinal axis of the axle. The axle axis is adapted to extend in a direction substantially perpendicular to a direction of exhaust flow through the conduit. A cantilevered spring pad has a first portion coupled to the valve plate and a second portion spaced apart from the valve plate. The second portion is oriented to contact an inner surface of the conduit as the valve plate moves toward the closed position to dampen vibration.

An exhaust pressure actuated valve assembly for placement inside a tubular exhaust conduit includes an axle extending through the conduit and a valve plate fixed to the axle and positioned in the conduit. The valve plate is rotatable between open and closed positions. A spring pad includes a first portion fixed to the valve plate and a second portion spaced apart from the valve plate such that the second portion is shaped as a cantilevered beam having one end fixed to the first portion and an opposite free distal end spaced apart from the valve plate. The spring pad is positioned to contact an inner surface of the conduit when the valve plate is in the closed position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

The objects and features of the present teachings will become apparent upon a reading of a detailed description, taken in conjunction with the drawing, in which.

Corresponding reference numerals indicate corresponding parts throughout the several views of the drawings.

DETAILED DESCRIPTION

Figure 1A:
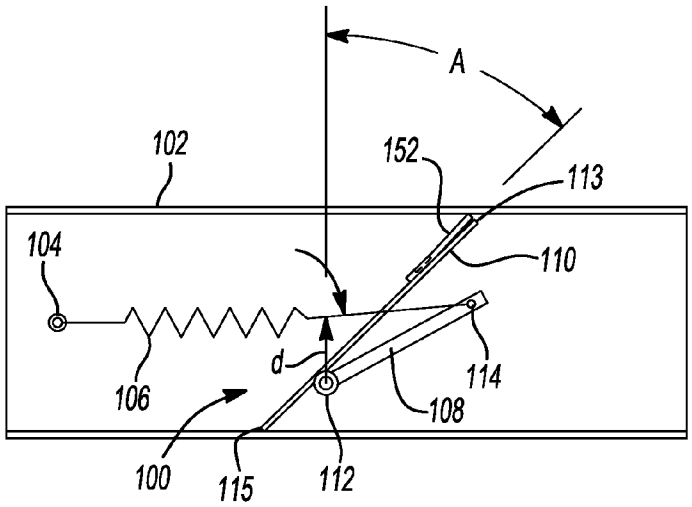
FIGS. 1A, 1B are respective side and end views of a valve controlling fluid flow through a conduit, the valve being in a closed position and arranged in accordance with the teachings of the present disclosure.

Example embodiments will now be described more fully with reference to the accompanying drawings.

An exhaust conduit 102 contains a snap-action valve 100 which includes a spring anchor 104, a valve spring 106, an external lever arm 108, a valve plate 110, a valve support shaft or axle 112 and a spring attachment 114 protruding from axle 112.

Figure 1B:
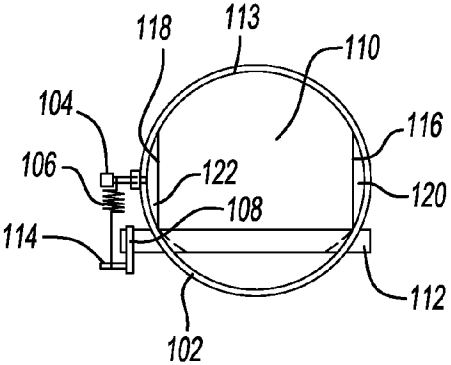
Figure 2A:
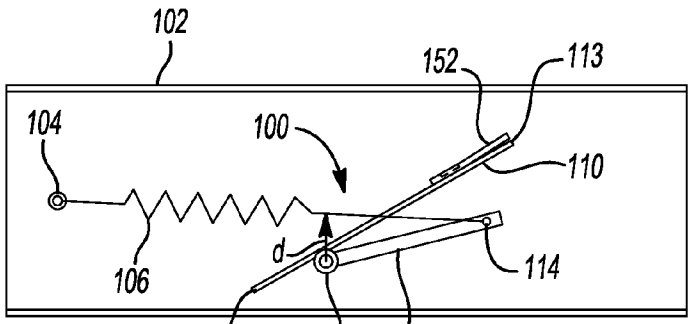
FIGS. 2A, 2B are respective side and end views of the valve of FIGS. 1A, 1B in a 15° open position.
Figure 2B:
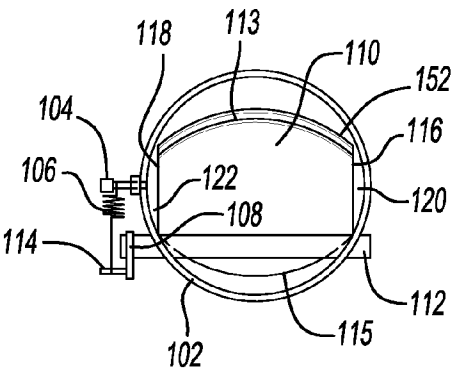
Figure 3B:
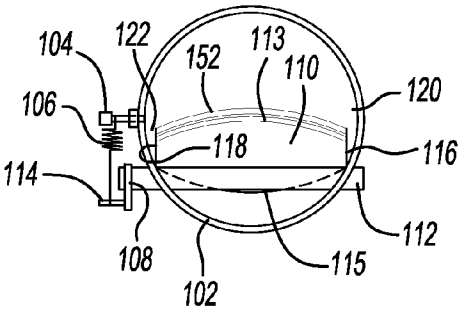
FIGS. 3A, 3B are respective side and end views of the valve of FIGS. 1A, 1B in a 30° open position.

Valve plate 110 has first and second arcuate edges 113, 115 substantially conforming to an interior arcuate surface of conduit 102. Valve plate 110 additionally has linear side edges 116 and 118 which provide clearance 120, 122 between valve plate 110 and an interior surface of conduit 102 when the valve plate is in the closed position shown in FIGS. 1A and 1B. Bias element or valve spring 106 extends between spring anchor 104 on conduit 102 and spring attachment 114 of external lever arm 108. Spring 106 biases valve plate 110 toward the closed positioned shown in FIG. 1A. When in the fully closed position, valve plate 110 resides at an angle other than 90° to a plane extending normal to the longitudinal axis of conduit 102. The angle of valve plate 110 with respect to a cross-sectional normal plane of conduit 102 is designated A.

Figure 4B:
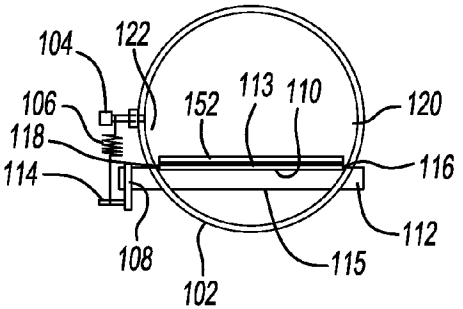
FIGS. 4A, 4B are respective side and end views of the valve of FIGS. 1A, 1B in a fully open position.
Figure 3A:
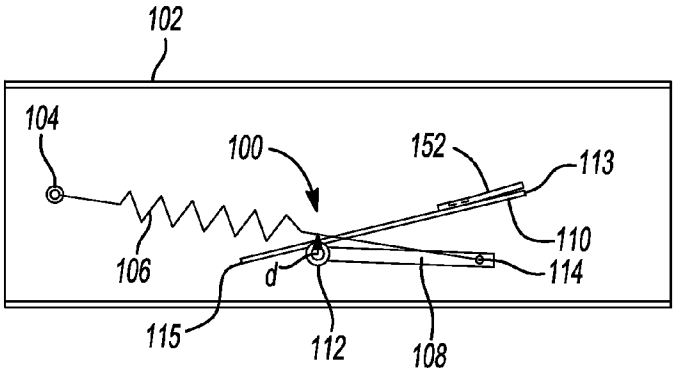

In operation, exhaust pressure is incident on valve plate 110 from the left as viewed in FIGS. 1A-4B. When the exhaust pressure is sufficient to overcome the bias force of spring 106, valve plate 110 will start to rotate about axle 112. The torque on valve plate 110 is determined by the bias spring force multiplied by the distance d which is the distance d between the axis of the spring 106 and axle 112. The spring force increases as the valve flap opens and the spring 106 stretches. However, d gets shorter as the valve continues to open resulting in the torque approaching zero as the longitudinal axis of spring 106 approaches an "over-center" position—i.e., as it approaches intersection with a longitudinal axis of the axle 112. This nearly over-center positioning of spring 106 results in a substantially horizontal position of valve plate 110 when in the fully open position as shown at FIG. 4A and FIG. 4B. This positioning, in turn, minimizes back pressure in the conduit when the valve is in the fully open position. Rotating valve plate 110 that spring 106 approaches the over-center condition also results in an easier maintenance of valve plate 110 in the fully opened position.

Figure 6:
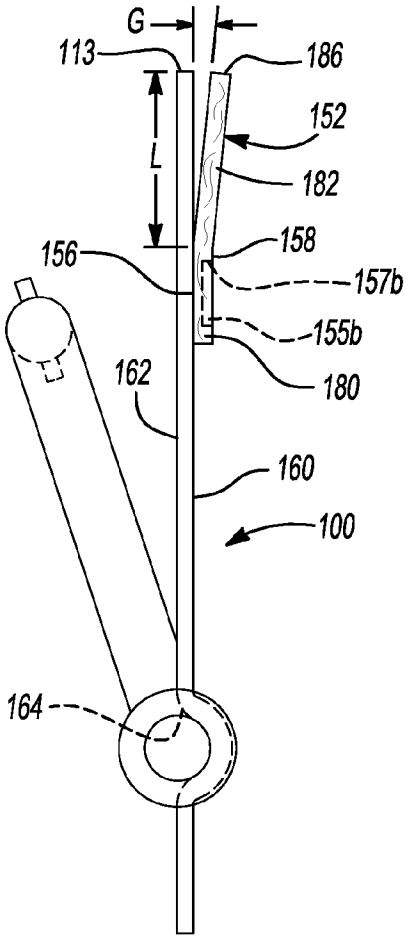
FIG. 6 is a side plan view of the valve plate assembly depicted in FIG. 5.
Figure 5:
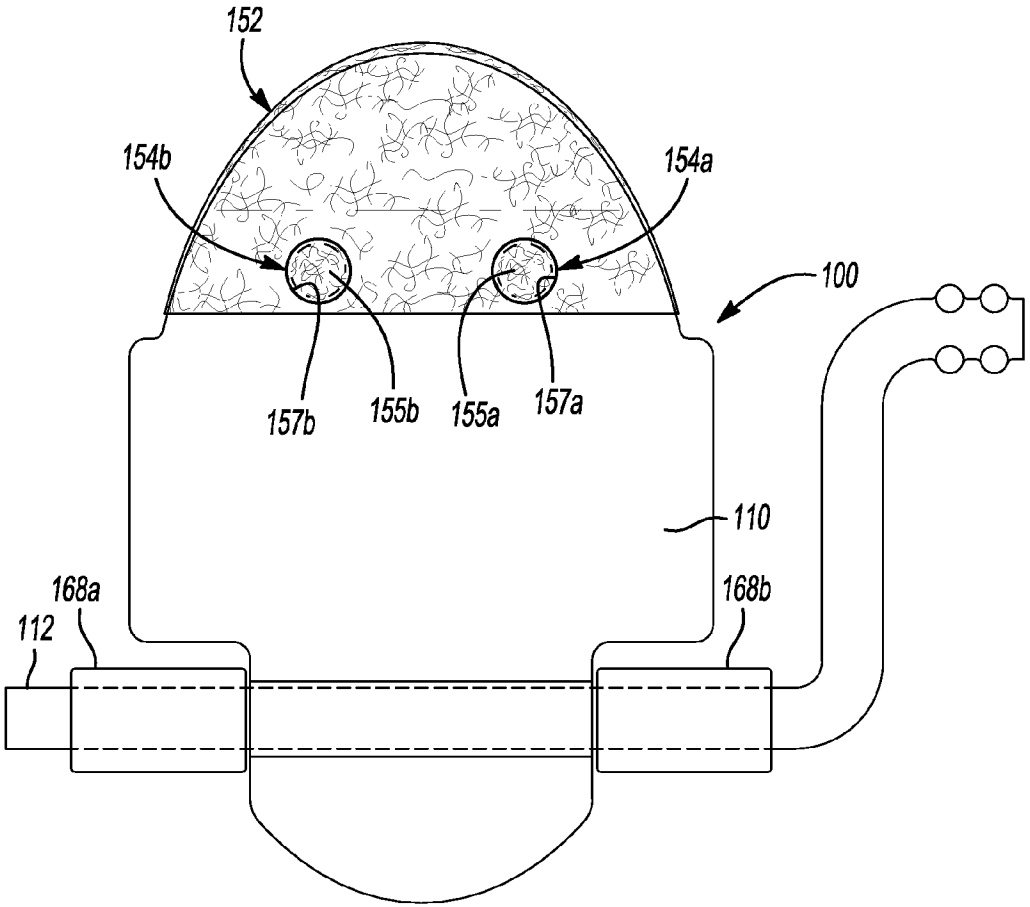
FIG. 5 is a front plan view of a valve plate assembly arranged in accordance with the teachings of the present disclosure.

As shown in FIGS. 5 and 6, valve plate 110 includes a first surface 160, an opposite second surface 162 and an indentation 164 in the valve plate for receipt of axle 112. Valve plate 110 and axle 112 are substantially similar to components of the snap action valve assembly disclosed in commonly assigned U.S. Pat. No. 7,434,570, herein incorporated by reference. An improvement to valve plate 110 is the addition of a cantilevered spring pad 152 having a first surface 156 and an opposite second surface 158. Spring pad 152 is preferably comprised of a resilient vibration absorbing knitted metal mesh material such as 316 stainless steel, 430 stainless steel, or Inconel.

Figure 4A:
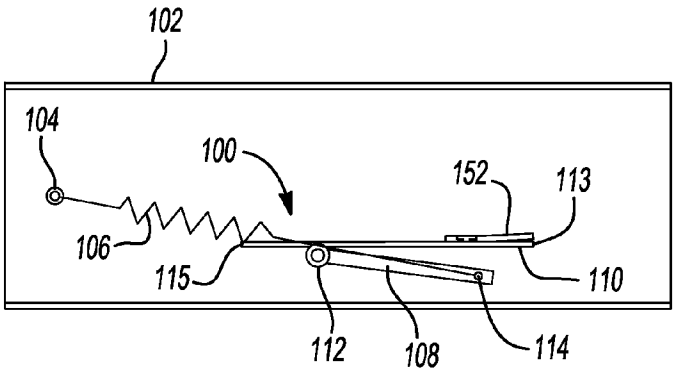

Additionally, it is to be noted that the conduit itself supplies the stop mechanism for the valve flap in both its fully closed and fully opened positions. In the fully closed position, spring pad 152 and arcuate edge 115 of valve plate 110 contact the interior surface of conduit 102 to define that position. Conversely, when in the fully opened position, as shown in FIGS. 4A and 4B, valve plate 110 utilizes its lateral linear edges (116 and 118 of FIG. 1B) to come into contact with the inner surface of conduit 102 to thereby provide a stop position for the fully opened position of valve plate 110.

Spring pad 152 includes compressed regions 154*a* and 154*b* having an increased density to promote stronger spot welding of spring pad 152 to valve plate 110 in the area of compressed regions 154*a* and 154*b*. Compressed regions 154*a* and 154*b* include substantially planar upper surfaces 155*a*, 155*b* having a circular perimeter, as shown. Compressed regions 154*a*, 154*b* define cylindrically-shaped pockets 157*a*, 157*b* inwardly extending from second surface 158.

Axle 112 includes first and second portions extending from opposite edges of valve plate 110. Each axle portion is surrounded by a bushing 168*a* and 168*b* which preferably also are comprised of knitted stainless steel mesh.

Spring pad 152 includes a first portion 180 including compressed regions 154*a*, 154*b* welded to valve plate 110. First surface 156 of spring pad 152 contacts first surface 160 of valve plate 110 at first portion 180. Spring pad 152 also includes a second or cantilevered portion 182 extending at a divergent angle to valve plate 110. The divergent angle may range from 10 to 25 degrees. Spring pad 152 is shaped such that a peripheral edge 186 of spring pad 152 is substantially aligned with or slightly overhangs arcuate edge 113 of valve plate 110. Spring pad 152 comes into contact with an inner surface of the conduit in which it is mounted when valve plate 110 swings toward its fully closed position as shown in solid lines in FIGS. 1A and 1B. Spring pad 152 cushions the impact between valve plate 110 and conduit 102 as the valve plate is rotated to the fully closed position. The wire mesh spring pad 152 dampens vibrations and minimizes noise associated with moving valve plate 110 toward conduit 102.

Cantilevered portion 182 of spring pad 152 includes a length "L". For an exemplary snap-action valve positioned in a conduit having an inner diameter of approximately 2.0 inches, length L may be approximately 0.5 inches. For a valve positioned in a conduit having an inner diameter of approximately 3.25 inches, the length L may be 1.0 inches. It should be appreciated that length "L" may be increased to reduce the amount of force required to deflect cantilevered portion 182 toward valve plate 110, thereby varying the spring rate of spring pad 152. It is contemplated that a gap identified at "G" may be set to a distance ranging from 3-6 mm when spring pad 152 is in the free, or unloaded state. As valve plate 110 moves toward the fully closed position, cantilevered portion 182 will contact the inner surface of conduit 102 and deflect toward valve plate 110 to decelerate the valve plate. Spring pad 152 may act as a damper to minimize the noise emitted during a valve closing operation.

It is also within the scope of the present disclosure to vary the density of the wire mesh defining spring pad 152 to range from a mesh density of substantially 20% to a mesh density of 40%. As the mesh density is reduced, it is easier to deflect cantilevered portion 182 toward valve plate 110 for a given load. In addition, because the mesh density is less, the thickness of the spring pad is compressed a greater amount for a given load. As such, the damping characteristics of the valve may be tuned by selecting a desired mesh density.

The valve damping characteristics may be further optimized by modifying the mesh wire diameter used to construct spring pad 152. It is contemplated that the mesh wire diameter may range from 0.06 mm to 0.15 mm. The thickness of the spring pad 152 may also be optimized to provide desirable damping characteristics. It is contemplated that a useful thickness range of spring pad 152 will lie between approximately 2.0 mm and 4.0 mm. It should be appreciated that spring pad 152 may reduce the sound emitted during a valve plate closing event through the use of cantilevered portion 182 deflecting under load as well as the wire mesh compressing under load.

Figure 8:
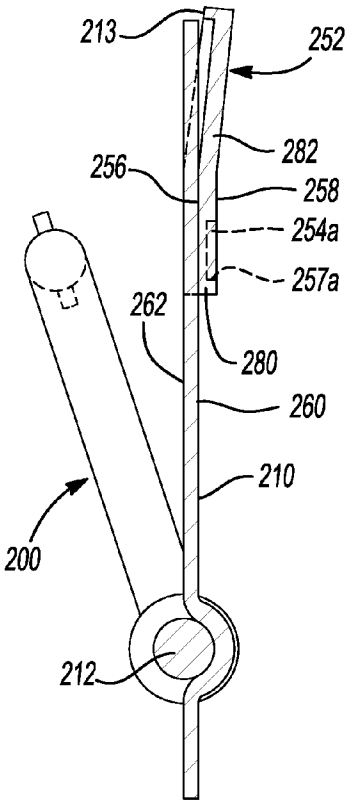
FIG. 8 is a cross-sectional view of the alternate valve plate assembly taken along line 8-8 shown in FIG. 7.
Figure 7:
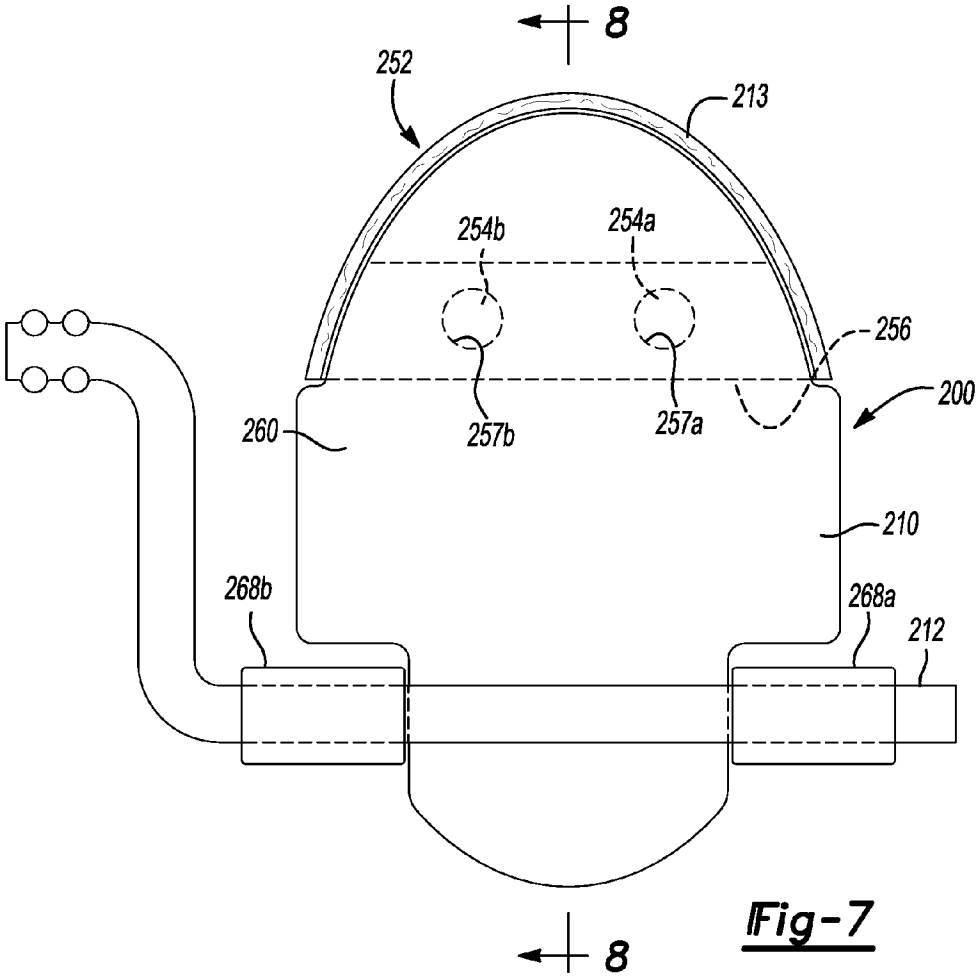
FIG. 7 is a front plan view of an alternate valve plate assembly.
Figure 9:
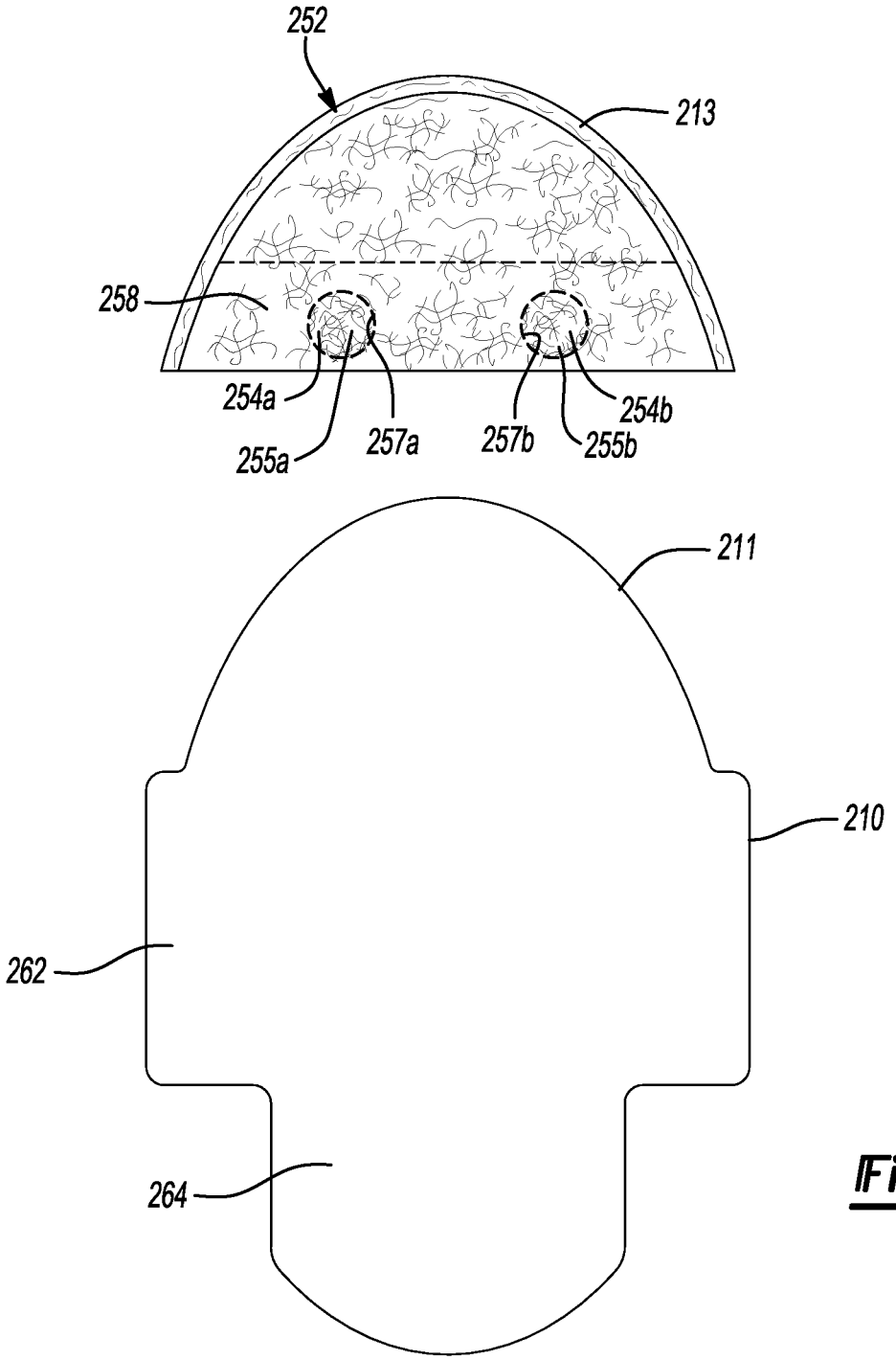
FIG. 9 is an exploded view of a spring pad and valve plate of the alternate plate assembly.

FIGS. 7-9 depict an alternate valve assembly identified at reference numeral 200. Valve 200 is substantially similar to valve 100. As such, similar elements will be identified with like reference numerals increased by 100. As best depicted in FIG. 9, valve plate 210 includes a scalloped portion 211 sized and shaped to receive a rib or lip 213 of spring pad 252. Rib 213 extends along a peripheral edge of spring pad 252. Scalloped portion 211 remains clear of rib 213 should cantilevered portion 282 deflect to such an extent. Rib 213 increases the spring constant associated with deflecting cantilevered portion 282 toward valve plate 210. Rib 213 also increases the structural rigidity of the spring pad 252 such that the spring pad maintains its intended shape during shipping and handling as well as after several opening and closing cycles of the valve.

It should be appreciated that both spring pad 152 and spring pad 252 are configured to include a gap between cantilevered portions 182, 282 and the respective valve plates 110, 210 in both a free state and a loaded state when the valve plate is in the closed position. When the valve plate moves from the closed position to the open position, cantilevered portion 182, 282 resiliently springs back to its initial position in the free and unloaded state. Similarly, the spring pad is only temporarily compressed to a reduced thickness when the valve plate is in a closed position. The spring pad resiliently returns to its initial thickness once the pad is no longer loaded into engagement with the interior surface of the conduit. Accordingly, the damping function of the spring pad will be useful at each valve plate closing event throughout the life of the valve.

The foregoing description has been provided for purposes of illustration and example. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An exhaust pressure actuated valve assembly for placement inside a tubular exhaust conduit, the valve assembly comprising:

a valve plate being rotatable between open and closed positions;

an axle adapted to pivotally couple the valve plate to the exhaust conduit about a longitudinal axis of the axle, the axle axis adapted to extend in a direction substantially perpendicular to a direction of exhaust flow through the conduit; and a cantilevered spring pad having a first portion coupled to the valve plate and a second portion spaced apart from the valve plate, the second portion being oriented to contact an inner surface of the conduit as the valve plate moves toward the closed position to dampen vibration.

2. The valve assembly of claim 1, wherein the spring pad comprises a knitted metal mesh.

3. The valve assembly of claim 2, wherein the knitted metal mesh comprises Inconel.

4. The valve assembly of claim 1, further comprising first and second vibration absorbing bushings respectively surrounding first and second portions of the axle.

5. The valve assembly of claim 2, wherein the knitted metal mesh comprises stainless steel.

6. The valve assembly of claim 1, wherein the first portion of the spring pad includes a compressed region welded to the valve plate.

7. The valve assembly of claim 6, wherein the compressed region includes a substantially circular upper surface.

8. The valve assembly of claim 1, wherein the spring pad includes a rib extending from a peripheral edge of the second portion.

9. The valve assembly of claim 8, wherein the rib is arcuately shaped.

10. The valve assembly of claim 1, wherein the spring pad includes a knitted metal mesh having a mesh density ranging from 20-40 percent.

11. An exhaust pressure actuated valve assembly for placement inside a tubular exhaust conduit, the valve assembly comprising:

an axle extending through the conduit;

a valve plate fixed to the axle and positioned in the conduit, the valve plate being rotatable between open and closed positions; and a spring pad including a first portion fixed to the valve plate and a second portion spaced apart from the valve plate such that the second portion is shaped as a cantilevered beam having one end fixed to the first portion and an opposite free distal end spaced apart from the valve plate, wherein the spring pad is positioned to contact an inner surface of the conduit when the valve plate is in the closed position.

12. The valve assembly of claim 11, wherein the spring pad includes a lip extending along a peripheral edge of the second portion.

13. The valve assembly of claim 12, wherein the lip remains spaced apart from and overlaps the valve plate when the valve plate is in the closed position.

14. The valve assembly of claim 11, wherein the free distal end contacts the conduit inner surface before the valve plate reaches the closed position.

15. The valve assembly of claim 14, wherein the free end of the second portion remains spaced apart from the valve plate when the valve plate is in the closed position.

16. The valve assembly of claim 11, wherein the free end of the second portion is spaced apart from the valve plate a distance ranging between 3.0 and 6.0 mm.

17. The valve assembly of claim 11, wherein the valve plate includes parallel linear edges that contact an inner surface of the conduit when the valve plate is in the open position.

18. The valve assembly of claim 11, wherein the first portion includes a substantially planar surface contacting the valve plate, the second portion including a substantially planar surface diverging from the valve plate at an angle ranging between 10 and 25 degrees.

* * * * *